US007640869B2

(12) United States Patent
Leng

(10) Patent No.: US 7,640,869 B2
(45) Date of Patent: Jan. 5, 2010

(54) HEIGHT-ADJUSTABLE FOLDING DESK

(76) Inventor: Luhao Leng, 139 West Fanghu Road, Fanghu Industry District, Xiamen, Fujian 361009 (CN)

( * ) Notice: Subject to any disclaimer, the term of this patent is extended or adjusted under 35 U.S.C. 154(b) by 140 days.

(21) Appl. No.: 11/944,136

(22) Filed: Nov. 21, 2007

(65) Prior Publication Data

US 2008/0271649 A1 Nov. 6, 2008

Related U.S. Application Data

(63) Continuation of application No. PCT/CN2004/000886, filed on Aug. 2, 2004.

(30) Foreign Application Priority Data

Oct. 7, 2003 (CN) ..... 2003 2 0106047 U
Nov. 21, 2003 (CN) ..... 2003 2 0107316 U

(51) Int. Cl.
*A47B 3/02* (2006.01)

(52) U.S. Cl. ..... 108/120; 108/116

(58) Field of Classification Search ..... 108/115, 108/125, 129, 131–133, 118–120; 248/188.1, 248/188.6, 161, 423, 157, 164, 439, 168, 248/188.2

See application file for complete search history.

(56) References Cited

U.S. PATENT DOCUMENTS 764,880 A * 7/1904 Coldwell ..... 108/132
1,778,124 A * 10/1930 Sauer ..... 108/132
2,675,286 A * 4/1954 Derman ..... 108/119
3,094,948 A * 6/1963 Clow ..... 108/10
4,032,103 A * 6/1977 Ehrichs ..... 248/421
4,249,636 A * 2/1981 Jackson et al. ..... 182/152
4,404,914 A * 9/1983 Taylor ..... 108/9
4,433,869 A * 2/1984 Payne et al. ..... 297/5
4,611,823 A * 9/1986 Haas ..... 280/641
4,615,523 A * 10/1986 Chen ..... 280/87.05
4,821,650 A * 4/1989 Simpson ..... 108/120
5,820,527 A * 10/1998 Lai ..... 482/68
6,912,961 B2 * 7/2005 Winter et al. ..... 108/118

* cited by examiner

*Primary Examiner*—Janet M Wilkens

(57) ABSTRACT

A height-adjustable folding desk includes a desktop and a leg-support connected to the lower surface of the desk. The leg support includes a first "⊓" shaped rod and a second "⊓" shaped rod. The two supporting-foot of the first "⊓" shaped rod are rotationally cross-connected with the two corresponding supporting feet of the second "⊓" shaped rod respectively. The horizontal rod of the first "⊓" shaped rod is pivotally connected with an end of the lower surface of the desktop, and the other end of the lower surface of the desktop is fixed with an adjustable equipment, the lower surface of the adjustable equipment comprises grooves which may contain the horizontal rod of the second "⊓" shape rod. The height of the folding table can be achieved by adjusting the position of the horizontal rod of the second "⊓" shaped rod.

12 Claims, 8 Drawing Sheets

HEIGHT-ADJUSTABLE FOLDING DESK

CROSS REFERENCE TO RELATED APPLICATIONS

This application is a continuation of International Application No. PCT/CN2004/00886, filed Aug. 2, 2004, which claims priority of Chinese Application Nos. 200320106047.3, filed Oct. 7, 2003 and 200320107316.8, filed Nov. 21, 2003. The disclosure of all prior applications are incorporated herein in their entirety by reference.

FIELD OF THE INVENTION

The invention relates to a folding desk, more particularly, to a height-adjustable folding desk.

BACKGROUND OF THE INVENTION

Folding desks are used in the home or office. In the office, small items can be put on the desk, or the desk can be used as a tea table or during meetings, papers, drawings, pens and so on can be put on the desk; at home, a desk can be used in studying, working, or ironing. Accordingly, the structure of a folding desk should be designed for easy folding and moving.

Currently, existing folding desks with leg-folding features, fall into two main categories: 1. The first one is where the two leg supports are vertically fixed to the two sides of the lower surface of the desk, and the leg supports can fold toward the middle of the desk; 2. The second one is composed of desk legs which are cross-connected with each other, forming a folding structure. For folding, because the former is not as easy as the latter, most folding desks adopt the latter format.

In both cases, the desk leg often uses a shrinking sleeve. This shrinking structure has the following drawbacks: 1. the shrinking structure leads the desk leg to have an overlapped portion, so material use is increased, increasing the cost of manufacture; 2. in order to adjust the height, one must use a fixing structure to keep the desk at the needed height. Because the stress to the fixing structure is great, the fixing structure is prone to breaking; 3. The four desk legs must be adjusted respectively, so the operation is inconvenient; 4. In the case of a folding desk which adopts crossed desk legs, the desk legs are kept at an angle of inclination, while the desk legs include a shrinking sleeve. This leads to great complexity and increased stress to the fixing structure, and greatly reduced stability. Accordingly, there is a need for an improved desk or table whose height can be conveniently adjusted.

SUMMARY OF THE INVENTION

This invention is to provide a height-adjustable folding desk. The aim is to resolve the above drawbacks of the prior art.

In one embodiment, the present invention provides a height-adjustable folding table or desk, which comprises a tabletop, a first support and a second support, wherein each of the first support and the second support comprises a left foot portion and a right foot portion linked via a connecting portion, wherein the left foot portions of the first and second foot supports are rotationally cross-connected with each other, and the right foot portions of the first and second foot supports are rotationally cross-connected with each other, wherein the connecting portion of the first foot support is pivotally connected with one end of the lower surface of the tabletop, wherein the other end of the lower surface of the tabletop comprises a fixture comprising an adjustment board which comprises a plurality of grooves configured to receive the connecting portion of the second foot support, and wherein the connecting portion of the second foot support is fitted into a groove of the adjustable fixture.

In a preferred embodiment of the height-adjustable folding table of the present invention, the fixture further comprises a pressure lever, and a torsion spring, wherein one end of the pressure lever is rotationally connected with the lower surface of the tabletop, the end of the pressure lever is the free end, and the torsion spring keeps the pressure lever in firm contact with the lower surface of the tabletop, or with the connecting portion of the second foot support if it is received in one of the plurality of grooves.

In certain embodiment of the height-adjustable folding table of the present invention, the fixture comprises two adjustment boards flanking the pressure lever, wherein the grooves of the two adjustment boards are positioned to correspond to each other for receiving the connecting portion of the second foot support.

In certain embodiment of the height-adjustable folding table of the present invention, the pressure lever is longer than the adjustment board, and the free end bends away from the under surface of the tabletop.

In certain embodiment of the height-adjustable folding table of the present invention, the pressure lever is T-shaped, having a traverse rod and a longitudinal rod, wherein the two ends of the transverse rod are pivotally connected with the lower surface of tabletop, wherein the torsion spring comprises a body, and two extending portion, wherein the transverse rod is inserted into the torsion spring body, one of the extending portion of the torsion spring is in contact with the lower surface of the tabletop, the other extending portion is hooked to the longitudinal rod of the T-shaped pressure lever.

In certain embodiment of the height-adjustable folding table of the present invention, the plurality of grooves are configured such that they have an approximately vertical inner wall on the side away from the free end of the pressure lever, and a sloped inner wall on the side near the free end of the pressure lever.

In certain embodiment of the height-adjustable folding table of the present invention, the adjustment board is formed on the desktop integrally.

In another embodiment, the height-adjustable folding table of the present invention comprises a tabletop, a first support and a second support, wherein each of the first support and the second support comprises a left foot portion and a right foot portion linked via a connecting portion, wherein the left foot portions of the first and second foot supports are rotationally cross-connected with each other, and the right foot portions of the first and second foot supports are rotationally cross-connected with each other, wherein the connecting portion of the first foot support is pivotally connected with one end of the lower surface of the tabletop, wherein the other end of the lower surface of the tabletop comprises fixture which comprises a pressure lever and a torsion spring, wherein one end of the pressure lever is rotationally connected with the lower surface of the tabletop, the end of the pressure lever is the free end, and the torsion spring keeps the pressure lever in firm contact with the lower surface of the tabletop, and wherein the pressure level further comprises a plurality of grooves facing the lower surface of the tabletop and configured to receive the connecting portion of the second foot support, and wherein the connecting portion of the second foot support is fitted into a groove of the pressure lever.

In certain embodiment of the height-adjustable folding table of the present invention, the pressure lever is T-shaped, having a traverse rod and a longitudinal rod, wherein the two ends of the transverse rod are pivotally connected with the lower surface of tabletop.

In certain embodiment of the height-adjustable folding table of the present invention, the plurality of grooves are configured such that they have an approximately vertical inner wall on the side away from the free end of the pressure lever, and a sloped inner wall on the side near the free end of the pressure lever.

In certain embodiment of the height-adjustable folding table of the present invention, a handle is set on one end of the transverse rod of the T-shaped adjustable rod, the handle being approximately perpendicular to the lower surface of the desk.

In certain embodiment of the height-adjustable folding table of the present invention, the torsion spring comprises a body, and two extending portion, wherein the transverse rod is inserted into the torsion spring body, one of the extending portion of the torsion spring is in contact with the lower surface of the tabletop, the other extending portion is hooked to the longitudinal rod of the T-shaped pressure lever.

In certain embodiment of the height-adjustable folding table of the present invention, the plurality of grooves are configured such that they have an approximately vertical inner wall on the side away from the free end of the pressure lever, and a sloped inner wall on the side near the free end of the pressure lever.

The technical project according to the invention is: a height-adjustable folding desk includes a desktop and a leg-support connected to the lower of desk. The leg-support includes a first "⊓" shape rod and a second "⊓" shape rod. Two supporting-foot of the first "⊓" shape rod rotationally cross-connect with two corresponding supporting-foot of the second "⊓" shape rod respectively. The horizontal rod of the first "⊓" shape rod pivotally connect with a side of the lower surface of the desktop, and the other side of the lower surface of the desktop fixes an adjustable equipment, the lower fringe of the adjustable equipment in length direction arranges some of containing grooves which may contain the horizontal rod of the second "⊓" shape rod.

Said adjustable equipment comprising: adjustable pieces, pressure lever, torsion spring, the containing grooves which may contain the horizontal rod of the second "⊓" shape rod are arranged in the lower fringe of the adjustable pieces in length direction, one end of the pressure lever is rotationally connected with the lower surface of desk, the torsion spring which has the pressure lever keep in contact with the lower fringe of the adjustable piece tightly is provided on the pressure lever; there are two adjustable pieces, the containing grooves positioned in the adjustable pieces correspond to each other, said pressure lever is positioned between the two adjustable pieces; the pressure lever is T-shaped, the two ends of the transverse rod are pivotally connected with the lower surface of desk, said torsion spring covers the transverse rod of T-shaped pressure lever, the extending portion of said torsion spring is in contact with the lower surface of the desk, the other extending portion hooks the lower of the longitudinal rod of the T-shaped pressure lever; the adjustable pieces are formed on the desk integrally.

Said adjustable equipment is an adjustable rod, one end of said adjustable rod is rotationally connected with the lower surface of the desk, the containing grooves which may contain the horizontal rod of the second "⊓" shape rod are arranged in the upper portion of the adjustable rod in length direction, the torsion spring which has the adjustable rod keep in contact with the lower surface of desk tightly is provided on the adjustable rod; the adjustable rod is T-shaped, the transverse rod of said T-shaped adjustable rod is pivotally connected with the lower surface of desk, the transverse containing grooves are positioned in the upper portion of the longitudinal rod, a spanner is set on one end of the transverse rod of the T-shaped adjustable rod, said spanner is approximately perpendicular to the lower surface of the desk, when the longitudinal rod of the T-shaped adjustable rod is tightly in contact with the lower surface of desk.

As mentioned above, compared with the existing height-adjustable folding desk, the advantage of this invention is as following: when adjusting the height, only pulling the end of the pressure lever or the adjustable rod of adjustable equipment downwardly for turning the longitudinal rod downwardly, moving the horizontal rod of the second "⊓" shape rod from one containing groove to another containing groove, and unhandholding the spanner, then the longitudinal rod of the T-shaped pressure lever or the adjustable rod is in reposition, and the horizontal rod of the second "⊓" shape rod is fixed in the containing groove. It is obvious that the manner for adjusting the height in the invention is much simpler than before, the first "⊓" shape rod is integral and the second "⊓" shape rod is integral too, so they can sustain great pressure and have strong stability.

BRIEF DESCRIPTION OF THE DRAWINGS

The present invention will be further explained with reference to the drawings and embodiments; the present invention will not be restricted by the embodiments.

DETAILED DESCRIPTION OF THE PREFERRED EMBODIMENTS

Embodiment 1

Figure 1:
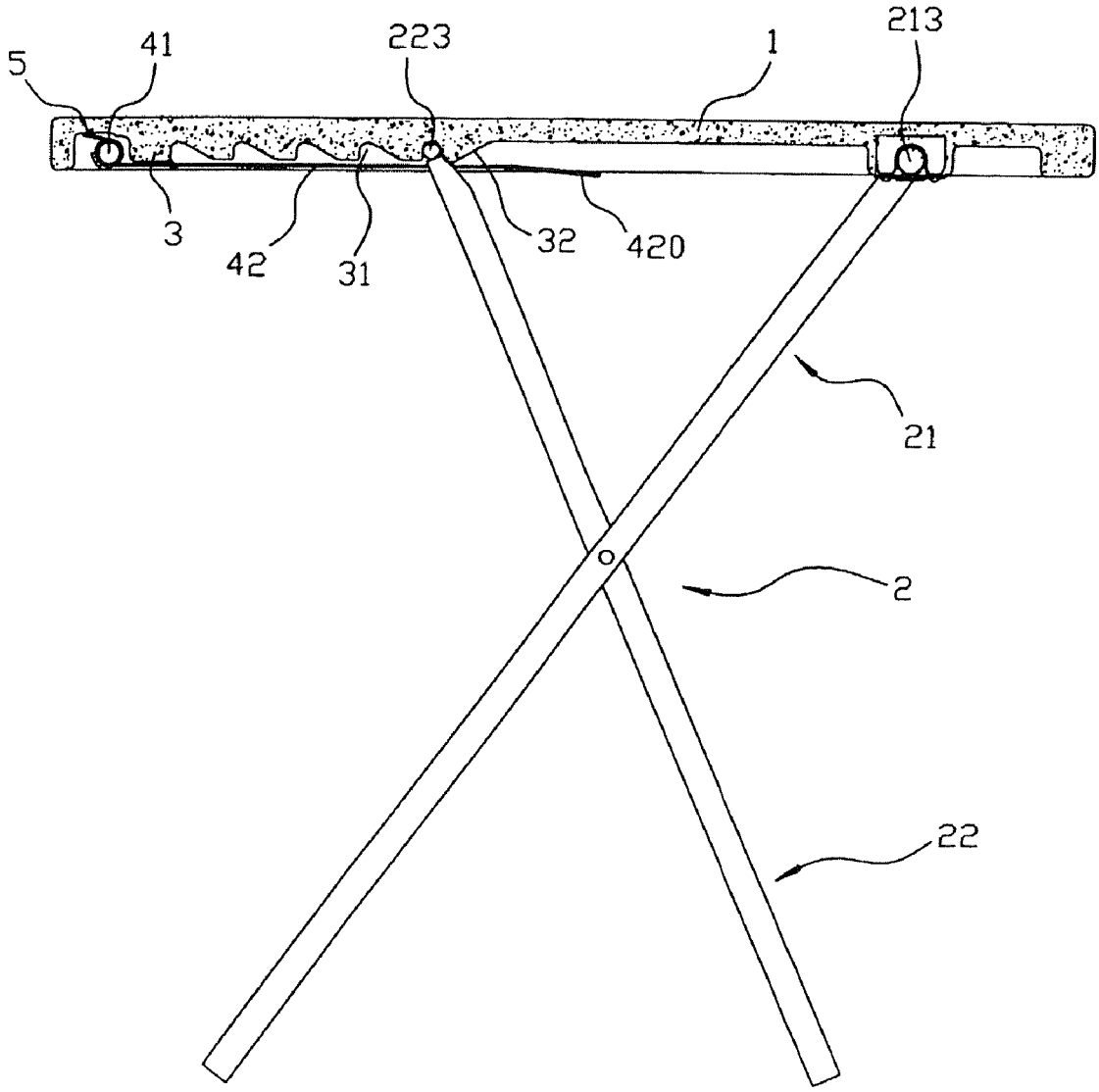
FIG. 1 is an illustrative view of the embodiment 1 shown in the using state and in the max height.
Figure 2:
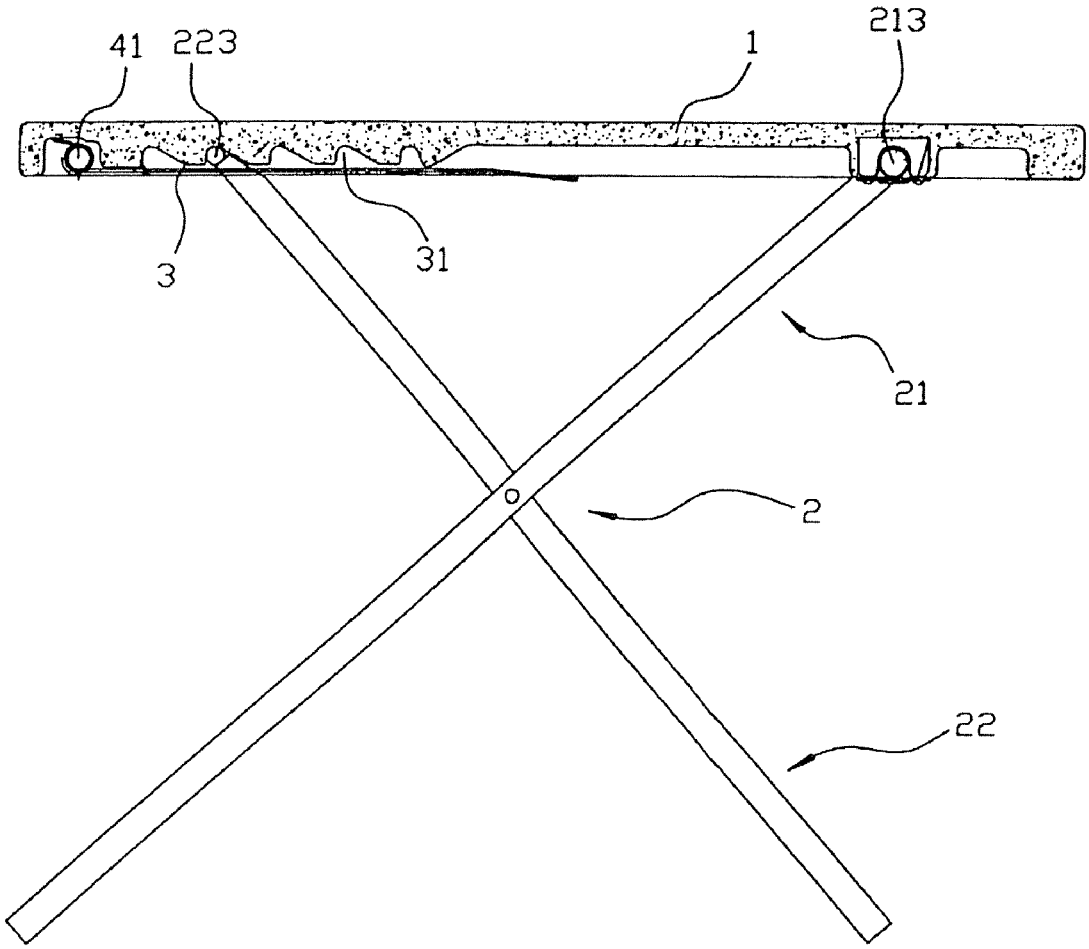
FIG. 2 is an illustrative view of the embodiment 1 shown in the using state and in a certain height.
Figure 3:
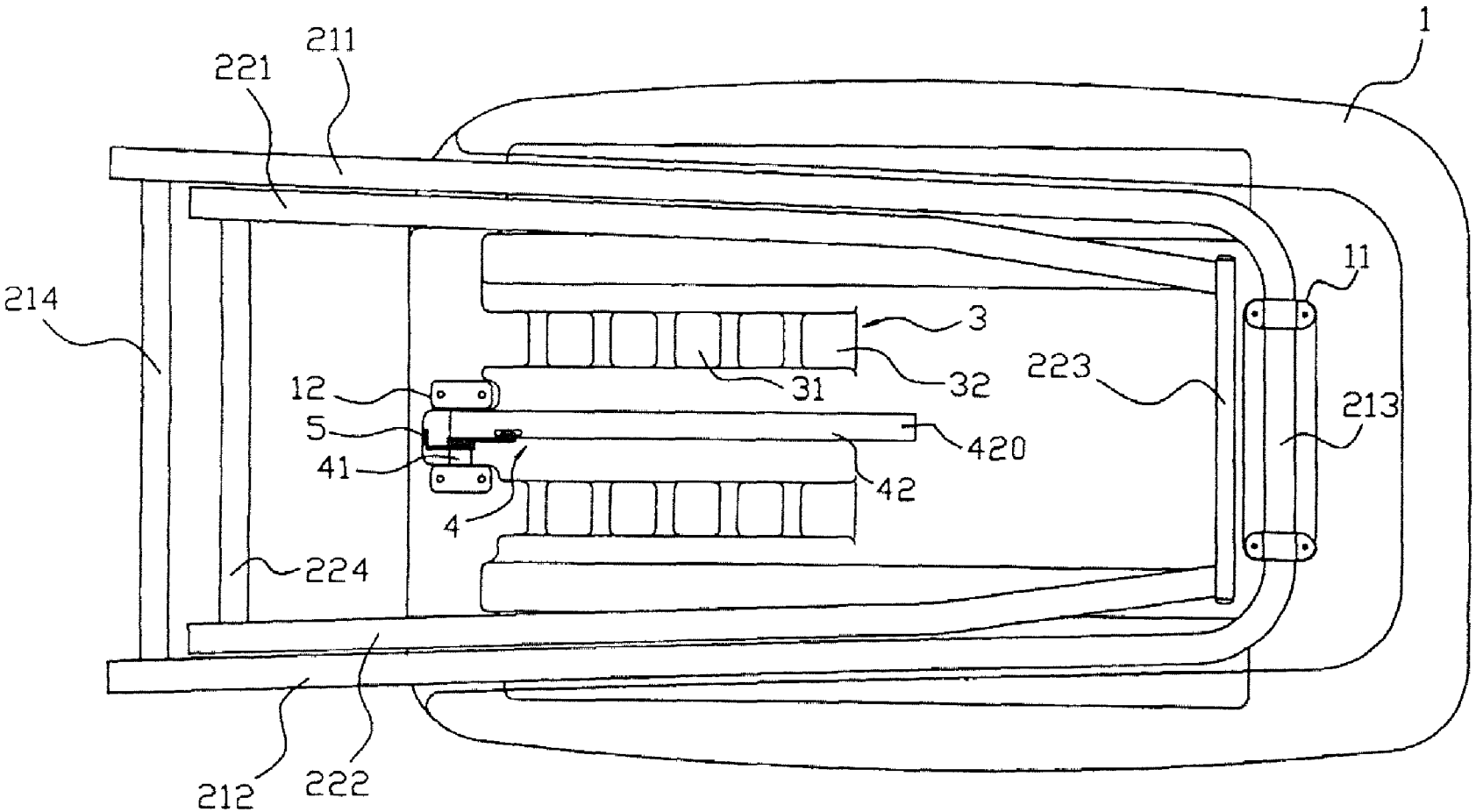
FIG. 3 is an illustrative view of the embodiment 1 shown in the folded state.
Figure 4:
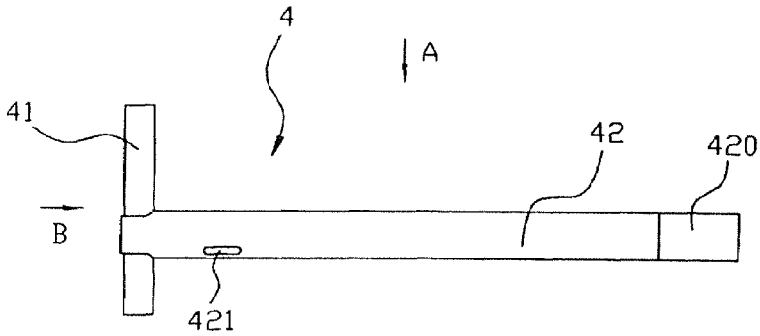
FIG. 4 is an illustrative view of the T-shaped pressure lever of the embodiment 1.
Figure 6:
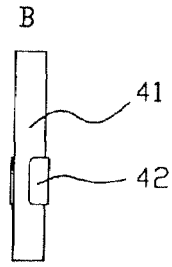
FIG. 6 is an illustrative view of the T-shaped pressure lever of the embodiment 1 from B direction.
Figure 5:
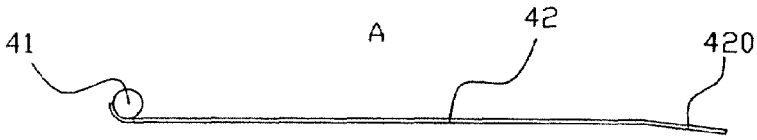
FIG. 5 is an illustrative view of the T-shaped pressure lever of the embodiment 1 from A direction.
Figure 7:
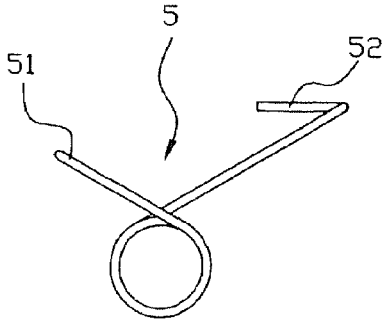
FIG. 7 is a structure view of the torsion spring.

Referring to FIG. 1-FIG. 7, a height-adjustable folding desk includes a desktop 1 and a leg-support 2 connected to the lower of desk 1. The leg-support 2 includes a first "⊓" shape rod 21 and a second "⊓" shape rod 22. The first "⊓" shape rod 21 is composed of a horizontal rod 213 and two supporting-foots 211, 212 which are integrated with the horizontal rod, the connecting rod 214 is connected between the lower portions of the two supporting-foots 211, 212; The second "⊓" shape rod 22 is composed of a horizontal rod 223 and two supporting-foots 221,222 which are connected with the two ends of the horizontal rod 223, the connecting rod 224 is connected between the lower portions of the two supporting-foots 221, 222; the supporting-foot 211 of the first "⊓" shape rod 21 is rotationally connected with the supporting-foot 221 of the second "⊓" shape rod 22 through the pivot which is positioned in the middle area of the supporting-foot, the supporting-foot 212 of the first "⊓" shape rod 21 is rotationally connected with the supporting-foot 222 of the second "⊓" shape rod 22 through the pivot which is positioned in the middle area of the supporting-foot, the supporting-foots 211,212 of the first "⊓" shape rod 21 are positioned between the supporting-foots 221,222 of the second "⊓" shape rod 22. The portion of the first "⊓" shape rod 21, which is above the rotationally connecting portion, is longer than the portion of the second "⊓" shape rod 22, which is above the rotationally connecting portion.

A first pivot joint portion 11 is positioned on one side of the lower surface of the desk 1, a second pivot joint portion 12 is positioned on the other side of the lower surface of the desk 1, the horizontal rod 213 of the first "⊓" shape rod 21 is pivotally connected with the lower surface of the desk through the first pivot joint portion 11, the two parallel adjustable pieces 3 are set on the other side of the lower surface of the desk 1, and said adjustable pieces 3 are integrated with desk 1, the length direction of the adjustable piece 3 is same as the desk 1, the corresponding containing grooves 31 which may contain the horizontal rod 223 of the second "⊓" shape rod 22 are respectively arranged in the lower fringe of the adjustable pieces 3 in length direction. The T-shaped pressure lever 4 is positioned between the adjustable pieces 3, and is parallel to the adjustable pieces 3, the T-shaped pressure lever 4 comprising: transverse rod 41 and longitudinal rod 42, said transverse rod 41 is rotationally connected with the second pivot joint portion 12, the longitudinal rod 42 can press the horizontal rod 223 of the second "⊓" shape rod 22 into the containing grooves 31, a strip-shaped bore 421 is provided in the longitudinal rod 42 of the T-shaped pressure lever 4, and the torsion spring 5 covers the transverse rod 41 of the T-shaped pressure lever 4, one extending end 51 of the torsion spring 5 against the lower surface of the desk 1, the other extending end 52 inserts to the strip-shaped bore 421 of the longitudinal rod 42 of the T-shaped pressure lever 4, under the function of the torsion spring 5, the longitudinal rod 42 of the T-shaped pressure lever 4 may press the horizontal rod 223 of the second "⊓" shape rod 22 into the containing grooves 31, so the longitudinal rod 42 of the T-shaped pressure lever 4 may press the horizontal rod 223 of the second "⊓" shape rod 22 into any containing grooves 31 which is positioned in the lower fringe of the adjustable pieces 3, then the leg-support 2 may supports the desk 1.

The length of the longitudinal rod 42 of the pressure lever 4 is longer than the length of the adjustable piece 3, and the free end 420 bends downwardly.

The inner side wall of the containing groove 31, which is close to the edge of desk 1, is an approximate vertical plane, and the inner side wall of the containing groove 31, which is close to the center of the desk 1, is an inclined plane, when adjusting the height, this structure is convenient for the horizontal rod 223 of the second "⊓" shape rod 22 slides out off the containing groove 31, and convenient for the leg support 2 preferably supports the desk 1. The lower portion of the end 32 of the adjustable pieces 3, which is close to the center of the desk, is an inclined plane.

When adjusting the height, only pulling the bending portion of the free end 420 of the longitudinal rod 42 of pressure lever 4 down, and the longitudinal rod 42 of the pressure lever 4 rotates downwardly, moving the horizontal rod 223 of the second "⊓" shape rod 22 from one containing groove 31 to another containing groove 31 based on requirement, and unhandholding the free end 420 of the longitudinal rod 42, then the longitudinal rod 42 of the T-shaped pressure lever 4 is in reposition under the function of the torsion spring 5, and the horizontal rod 223 of the second "⊓" shape rod 22 is fixed in the containing groove 31 of the adjustable piece 3.

When folding the desk, pulling the bending portion of the free end 420 of the longitudinal rod 42 of pressure lever 4 down, and the longitudinal rod 42 of the pressure lever 4 rotates downwardly, sliding the horizontal rod 223 of the second "⊓" shape rod 22 out off the containing groove 31 of the adjustable piece 3, moving the horizontal rod 223 of the second "⊓" shape rod 22 toward the horizontal rod 213 of the first "⊓" shape rod 21, keeping the leg-support be in contact with the lower surface of the desk.

The present invention is not limited by the above-mentioned embodiments, other similar structure can be obtained through noncreative change, for example, the supporting-foots 211,212 of the first "⊓" shape rod 21 are designed to be positioned outside the supporting-foots 221,222 of the second "⊓" shape rod 22. Through simple change, when folding the desk, moving the horizontal rod 223 of the second "⊓" shape rod 22 far away the horizontal rod 213 of the first "⊓" shape rod 21, the main design philosophy of this invention is to adjust the height of the folding table by adjusting the included angle of the crossed desk legs.

Embodiment 2

Figure 8:
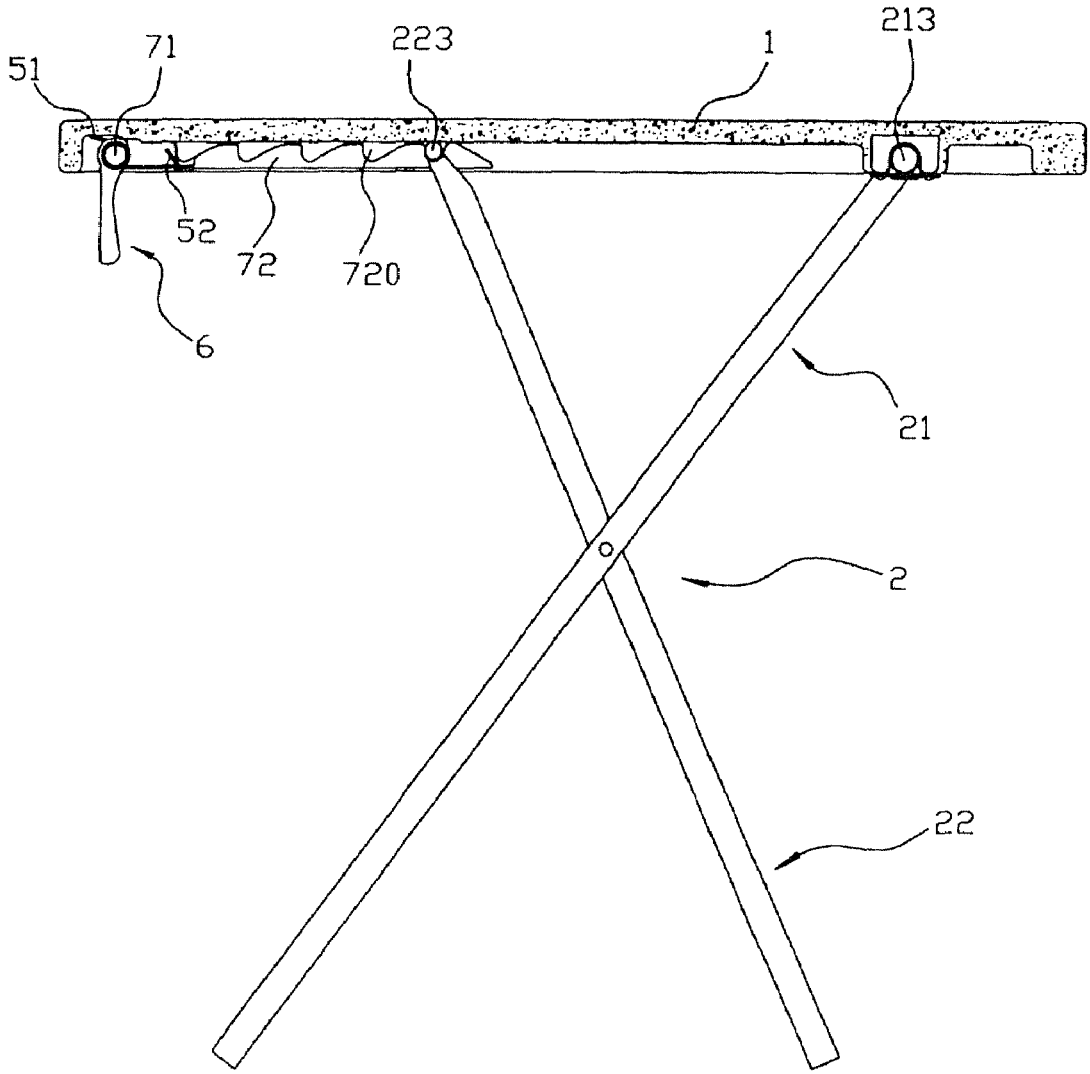
FIG. 8 is an illustrative view of the embodiment 2 shown in the using state and in the max height.
Figure 9:
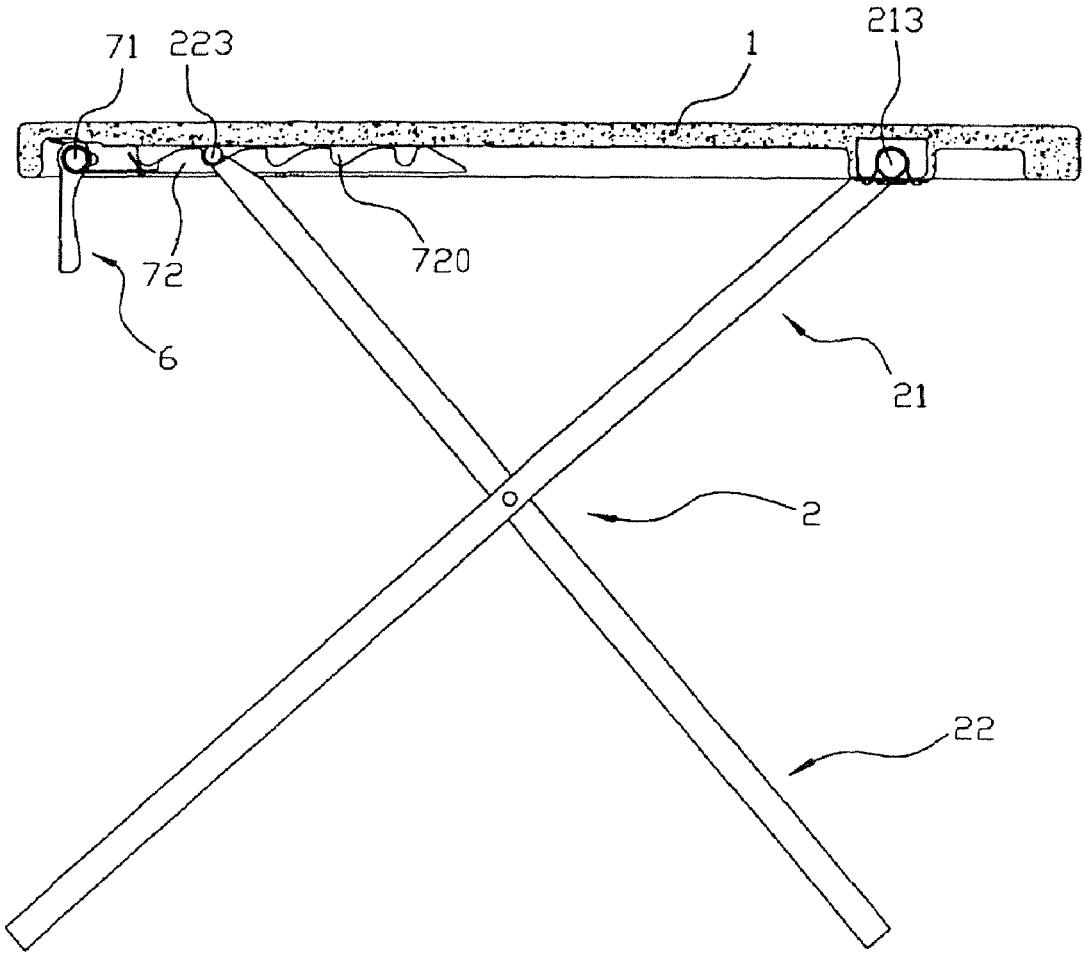
FIG. 9 is an illustrative view of the embodiment 2 shown in the using state and in a certain height.
Figure 10:
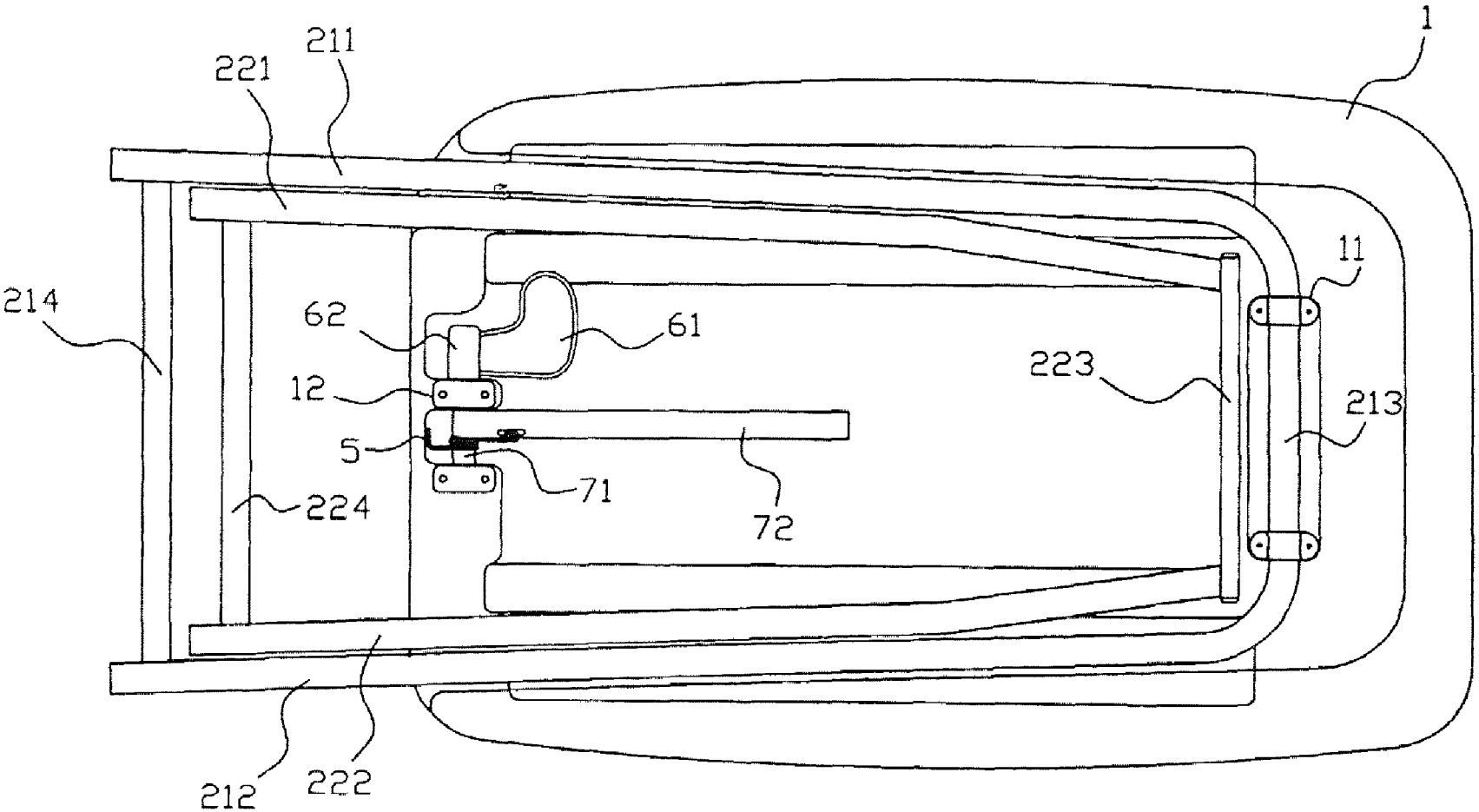
FIG. 10 is an illustrative view of the embodiment 2 shown in the folded state.
Figure 11:
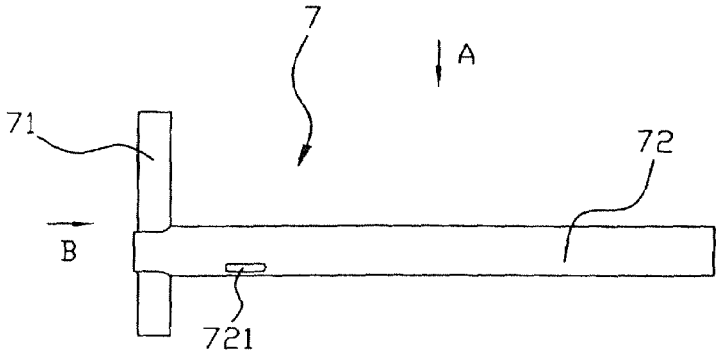
FIG. 11 is an illustrative view of the T-shaped pressure lever of the embodiment 2.
Figure 13:
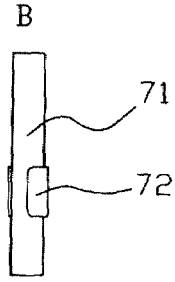
FIG. 13 is an illustrative view of the T-shaped pressure lever of the embodiment 2 from B direction.
Figure 12:
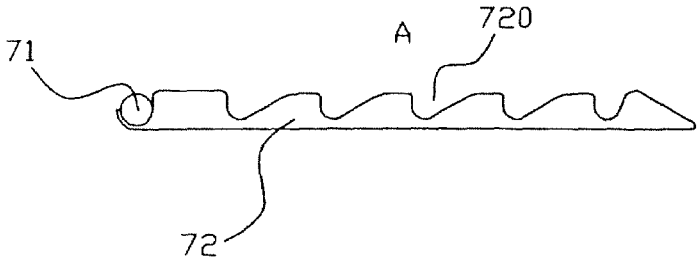
FIG. 12 is an illustrative view of the T-shaped pressure lever of the embodiment 2 from A direction.

Referring to FIG. 5~FIG. 12, compared with the embodiment 1, the main difference is: the adjustable equipment is an adjustable rod. a height-adjustable folding desk includes a desktop 1 and a leg-support 2 connected to the lower of desk 1. The leg-support 2 includes a first "⊓" shape rod 21 and a second "⊓" shape rod 22. The first "⊓" shape rod 21 is composed of a horizontal rod 213 and two supporting-foots 211, 212 which are integrated with the horizontal rod, the connecting rod 214 is connected between the lower portions of the two supporting-foots 211, 212; The second "⊓" shape rod 22 is composed of a horizontal rod 223 and two supporting-foots 221,222 which are connected with the two ends of the horizontal rod 223, the connecting rod 224 is connected between the lower portions of the two supporting-foots 221, 222; the supporting-foot 211 of the first "⊓" shape rod 21 is rotationally connected with the supporting-foot 221 of the second "⊓" shape rod 22 through the pivot which is positioned in the middle area of the supporting-foot, the supporting-foot 212 of the first "⊓" shape rod 21 is rotationally connected with the supporting-foot 222 of the second "⊓" shape rod 22 through the pivot which is positioned in the middle area of the supporting-foot, the supporting-foots 211, 212 of the first "⊓" shape rod 21 are positioned between the supporting-foots 221,222 of the second "⊓" shape rod 22. The portion of the first "⊓" shape rod 21, which is above the rotationally connecting portion, is longer than the portion of the second "⊓" shape rod 22, which is above the rotationally connecting portion.

A first pivot joint portion 11 is positioned on one side of the lower surface of the desk 1, a second pivot joint portion 12 is positioned on the other side of the lower surface of the desk 1, the horizontal rod 213 of the first "⊓" shape rod 21 is pivotally connected with the lower surface of the desk through the first pivot joint portion 11, there is a T-shaped adjustable rod 7, the transverse rod 71 of said T-shaped adjustable rod 7 is pivotally connected with the lower surface of desk through the second pivot joint portion 12, the containing grooves 720 which may contain the horizontal rod 223 of the second "⊓" shape rod 22 are arranged in the upper portion of the longitudinal rod 72 in length direction, the torsion spring 5 covers the transverse rod 71 of the T-shaped adjustable rod 7, one extending end 51 of the torsion spring 5 against the lower surface of the desk 2, the other extending end 52 inserts to the strip-shaped bore 721 of the longitudinal rod 72 of the T-shaped adjustable rod 7, under the function of the torsion spring 5, the longitudinal rod 72 of the T-shaped adjustable rod 7 may be in contact with the lower surface of the desk 1, so any containing groove 720 positioned in the upper portion of the longitudinal rod 72 of the T-shaped adjustable rod 7 can keep the horizontal rod 223 of the second "⊓" shape rod 22 be in contact with the lower surface of the desk 1, then the leg-support 2 may supports the desk 1.

A spanner 6 is set on one end of the transverse rod 71 of the T-shaped adjustable rod 7, the spanner 6 includes a fixing portion 62 and an ear-shaped body 61, the fixing portion 62 is fixed on one end of the transverse rod 71 of the T-shaped adjustable rod 7, the ear-shaped body 61 is approximately perpendicular to the lower surface of the desk 1, when the longitudinal rod 72 of the T-shaped adjustable rod 7 is tightly in contact with the lower surface of desk 1.

The inner side wall of containing groove 720 positioned in the upper portion of the longitudinal rod 72 of the T-shaped adjustable rod 7, which is close to the edge of desk 1, is an approximate vertical plane, and the inner side wall of the containing groove 720, which is close to the center of the desk 1, is an inclined plane, when adjusting the height, this structure is convenient for the horizontal rod 223 of the second "⊓" shape rod 22 slides out off the containing groove 720, the upper portion of the end of the longitudinal rod 72 of the T-shaped adjustable rod 7, which is close to the center of the desk 1, is an inclined plane, this structure is convenient for the horizontal rod 223 of the second "⊓" shape rod 22 slides out off the end of the longitudinal rod 72 of the T-shaped adjustable rod 7.

When adjusting the height, only pulling spanner 6 outwardly, and the longitudinal rod 72 of the T-shaped adjustable rod 7 rotates downwardly, moving the horizontal rod 223 of the second "⊓" shape rod 22 from one containing groove 720 positioned in the upper portion of the longitudinal rod 72 of the T-shaped adjustable rod 7 to another containing groove 720 based on requirement, and unhandholding the spanner 6, then the longitudinal rod 72 of the T-shaped adjustable rod 7 is in reposition under the function of the torsion spring 4, and the horizontal rod 223 of the second "⊓" shape rod 22 is fixed in the lower surface of the desk.

When folding the desk, pulling spanner 6 outwardly, and the longitudinal rod 72 of the T-shaped adjustable rod 7 rotates downwardly, sliding the horizontal rod 223 of the second "⊓" shape rod 22 out off the containing groove 720 positioned in the upper portion of the longitudinal rod 72 of the T-shaped adjustable rod 7, moving the horizontal rod 223 of the second "⊓" shape rod 22 toward the horizontal rod 213 of the first "⊓" shape rod 21, keeping the leg-support be in contact with the lower surface of the desk.

The present invention is not limited by the above-mentioned embodiments, other similar structure can be obtained through noncreative change, for example, the supporting-foots 211,212 of the first "⊓" shape rod 21 are designed to be positioned outside the supporting-foots 221,222 of the second "⊓" shape rod 22. Through simple change, when folding the desk, moving the horizontal rod 223 of the second "⊓" shape rod 22 far away the horizontal rod 213 of the first "⊓" shape rod 21, the main design philosophy of this invention is to adjust the height of the folding table by adjusting the included angle of the crossed desk legs.

INDUSTRIAL APPLICABILITY

The present height-adjustable folding desk, the leg-support is composed of a first "⊓" shape rod and a second "⊓" shape rod. The horizontal rod of the first "⊓" shape rod pivotally connect with a side of the lower surface of the desktop, the horizontal rod of the second "⊓" shape rod is positioned in the containing groove of adjustable equipment, the objective of adjusting the height of the folding table can be achieved by adjusting the position of the horizontal rod of the second "⊓" shape rod, said folding desk has following advantage: simple structure, easy to use, easy processing, so it has good industrial applicability.

The invention claimed is:

1. A height-adjustable folding table, comprising: a tabletop, a first support and a second support, wherein each of the first support and the second support comprises a left foot portion and a right foot portion linked via a connecting portion, wherein the left foot portions of the first and second foot supports are rotationally cross-connected with each other, and the right foot portions of the first and second foot supports are rotationally cross-connected with each other, wherein the connecting portion of the first foot support is pivotally connected with one end of the lower surface of the tabletop, wherein the other end of the lower surface of the tabletop comprises a fixture comprising an adjustment board which comprises a plurality of grooves configured to receive the connecting portion of the second foot support, and wherein the connecting portion of the second foot support is fitted into a groove of the adjustable fixture, wherein the fixture further comprises a pressure lever, and a torsion spring, wherein one end of the pressure lever is rotationally connected with the lower surface of the tabletop, the end of the pressure lever is the free end, and the torsion spring keeps the pressure lever in firm contact with the lower surface of the tabletop, or with the connecting portion of the second foot support if it is received in one of the plurality of grooves.

2. The height-adjustable folding table of claim 1, wherein the fixture comprises two adjustment boards flanking the pressure lever, wherein the grooves of the two adjustment boards are positioned to correspond to each other for receiving the connecting portion of the second foot support.

3. The height-adjustable folding table of claim 1, wherein the pressure lever is longer than the adjustment board, and the free end bends away from the under surface of the tabletop.

4. The height-adjustable folding table of claim 1, wherein the pressure lever is T-shaped, having a traverse rod and a longitudinal rod, wherein the two ends of the transverse rod are pivotally connected with the lower surface of tabletop, wherein the torsion spring comprises a body, and two extending portion, wherein the transverse rod is inserted into the torsion spring body, one of the extending portion of the torsion spring is in contact with the lower surface of the tabletop, the other extending portion is hooked to the longitudinal rod of the T-shaped pressure lever.

5. The height-adjustable folding table of claim 1, wherein the plurality of grooves are configured such that they have an approximately vertical inner wall on the side away from the free end of the pressure lever, and a sloped inner wall on the side near the free end of the pressure lever.

6. The height-adjustable folding table of claim 1, wherein the adjustment board is formed on the tabletop, integrally.

7. A height-adjustable folding table, comprising: a tabletop, a first support and a second support, wherein each of the first support and the second support comprises a left foot portion and a right foot portion linked via a connecting portion, wherein the left foot portions of the first and second foot supports are rotationally cross-connected with each other, and the right foot portions of the first and wherein the connecting portion of the first foot support is pivotally connected with on end of the lower surface of the tabletop, wherein the other end of the lower surface of the tabletop comprises fixture which comprises a pressure lever and a torsion spring, wherein one end of the pressure lever is rotationally connected with the lower surface of the tabletop, the end of the pressure lever is the free end, and the torsion spring keeps the pressure lever in firm contact with the lower surface of the tabletop, and wherein the pressure lever further comprises a plurality of grooves facing the lower surface of the tabletop and configured to receive the connecting portion of the second foot support, and wherein the connecting portion of the second foot support is fitted into one of said grooves of the pressure lever.

8. The height-adjustable folding table of claim 7, wherein the pressure lever is T-shaped, having a traverse rod and a longitudinal rod, wherein the two ends of the transverse rod are pivotally connected with the lower surface of tabletop.

9. The height-adjustable folding table of claim 8, wherein the plurality of grooves are configured such that they have an approximately vertical inner wall on the side away from the free end of the pressure lever, and a sloped inner wall on the side near the free end of the pressure lever.

10. The height-adjustable folding table of claim 8, wherein a handle is set on one end of the transverse rod of the T-shaped adjustable rod, the handle being approximately perpendicular to the lower surface of the desk.

11. The height-adjustable folding table of claim 8, wherein the torsion spring comprising a body, and two extending portion, wherein the transverse rod is inserted into the torsion spring body, one of the extending portion of the torsion spring is in contact with the lower surface of the tabletop, the other extending portion is hooked to the longitudinal rod of the T-shaped pressure lever.

12. The height-adjustable folding table of claim 8, wherein the plurality of grooves are configured such that they have an approximately vertical inner wall on the side away from the free end of the pressure lever, and a sloped inner wall on the side near the free end of the pressure lever.

* * * * *

UNITED STATES PATENT AND TRADEMARK OFFICE

CERTIFICATE OF CORRECTION

PATENT NO. : 7,640,869 B2
APPLICATION NO. : 11/944136
DATED : January 5, 2010
INVENTOR(S) : Luhao Leng It is certified that error appears in the above-identified patent and that said Letters Patent is hereby corrected as shown below:

In the Claims:

Column 9, line 8, claim 7 should read as follows:

7. A height-adjustable folding table, comprising: a tabletop, a first support and a second support, wherein each of the first support and the second support comprises a left foot portion and a right foot portion linked via a connecting portion, wherein the left foot portions of the first and second foot supports are rotationally cross-connected with each other, and the right foot portions of the first and <u>second foot supports are rotationally cross-connected with each other,</u> wherein the connecting portion of the first foot support is pivotally connected with <u>one</u> ~~on~~ end of the lower surface of the tabletop, wherein the other end of the lower surface of the tabletop comprises <u>a</u> fixture which comprises a pressure lever and a torsion spring, wherein one end of the pressure lever is rotationally connected with the lower surface of the tabletop, the <u>other</u> end of the pressure lever is the free end, and the torsion spring keeps the pressure lever in firm contact with the lower surface of the tabletop, and wherein the pressure lever further comprises a plurality of grooves facing the lower surface of the tabletop and configured to receive the connecting portion of the second foot support, and wherein the connecting port of the second foot support is fitted into one of said grooves of the pressure lever.

Signed and Sealed this
Twenty-sixth Day of November, 2013

Margaret A. Focarino

Margaret A. Focarino
*Commissioner for Patents of the United States Patent and Trademark Office*